United States Patent [19]

Krage et al.

[11] Patent Number: 4,784,515

[45] Date of Patent: Nov. 15, 1988

[54] COLLAPSIBLE HIGHWAY BARRIER

[75] Inventors: William G. Krage, Fair Oaks; Owen S. Denman, Roseville, both of Calif.

[73] Assignee: Energy Absorption Systems, Inc., Chicago, Ill.

[21] Appl. No.: 161,405

[22] Filed: Feb. 23, 1988

Related U.S. Application Data

[63] Continuation of Ser. No. 858,591, May 1, 1986, abandoned, which is a continuation-in-part of Ser. No. 457,126, Jan. 11, 1983, Pat. No. 4,607,824.

[51] Int. Cl.[4] ..... A01K 3/00; E01F 15/00

[52] U.S. Cl. ..... 404/6; 256/13.1

[58] Field of Search ..... 404/6; 188/32; 256/13.1

[56] References Cited

U.S. PATENT DOCUMENTS

| | | | |
|---|---|---|---|
| 1,867,671 | 7/1932 | Massoll . | |
| 1,870,639 | 8/1932 | Mueller . | |
| 2,004,026 | 6/1935 | Wooten | 256/13.1 |
| 2,121,379 | 6/1938 | Young | 189/23 |
| 2,204,557 | 6/1940 | Ahles | 256/13.1 |
| 2,776,116 | 1/1957 | Brickman | 256/13.1 |
| 2,974,934 | 3/1961 | White | 256/13.1 |
| 3,643,924 | 2/1972 | Fitch | 256/13.1 |
| 3,796,410 | 3/1974 | Konstant | 256/1 |
| 3,845,936 | 11/1974 | Boedecker, Jr. et al. | 256/1 |
| 3,856,268 | 12/1974 | Fitch | 256/13.1 |
| 4,198,036 | 4/1980 | O'Neal | 188/32 X |
| 4,330,106 | 5/1982 | Chisholm | 256/13.1 |
| 4,607,824 | 8/1986 | Krage et al. | 256/13.1 |
| 4,678,166 | 7/1987 | Bronstad et al. | 256/13.1 |

FOREIGN PATENT DOCUMENTS

| | | | |
|---|---|---|---|
| 2161356 | 1/1973 | France . | |
| 2238013 | 2/1975 | France . | |
| 2265918 | 10/1975 | France | 256/13.1 |
| 2279887 | 2/1976 | France | 256/13.1 |

*Primary Examiner*—Jerome W. Massie, IV
*Assistant Examiner*—Matthew Smith
*Attorney, Agent, or Firm*—Willian Brinks Olds Hofer Gilson & Lione Ltd.

[57] ABSTRACT

A highway barrier includes a collapsible guardrail assembly and a rotatable beam which is mounted between the rearward end of the guardrail assembly and a roadside hazard. The collapsible guardrail assembly includes a plurality of overlapping panels, adjacent ones of which are secured together by fasteners riding in slots. The fasteners are designed to retain the panels together after the impact and the fasteners are positioned with respect to the panels to cause the panels to tend to rotate away from the roadside during the impact, thereby redirecting the vehicle away from the roadway. The beam is rotatably mounted to the roadside hazard by a band and the forward end of the beam as well as the forward end of each of the panels is supported above the ground on a respective slip base designed to release in response to axial forces and to resist lateral forces. When an impacting vehicle engages the beam, the beam rotates away from the roadway around the roadside hazard, thereby redirecting the vehicle away from the hazard.

15 Claims, 7 Drawing Sheets

1a.
3.
10
12
14
18
18a
18b
18e
20
21
22
23
26
27
28
28a
29
30
30a
30b
31
33
46
48
50
56
57
58
60
62
64
70
72
74
76
78
82
84
86
88

FIG. 4
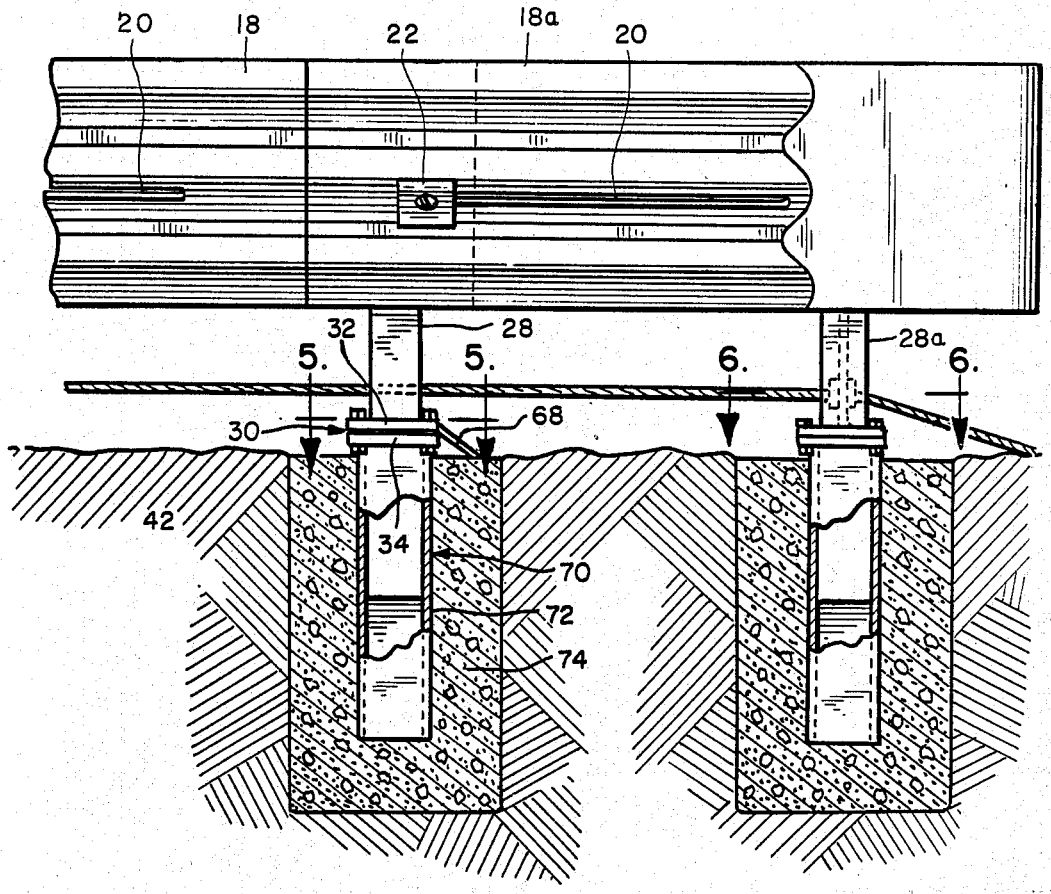
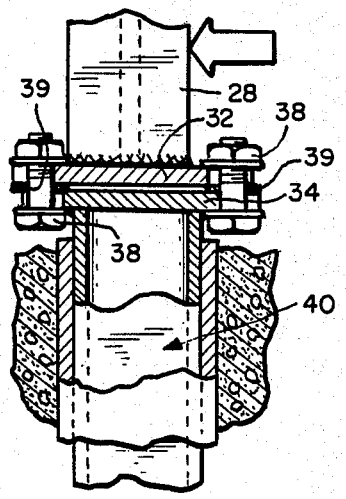
FIG. 7
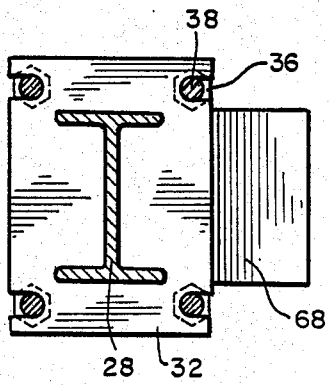
FIG. 5
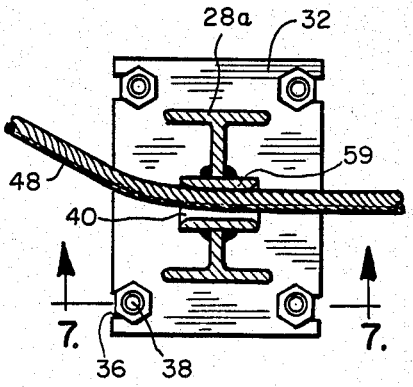
FIG. 6

COLLAPSIBLE HIGHWAY BARRIER

CROSS REFERENCE TO RELATED APPLICATION

This application is a continuation of application Ser. No. 858,591, filed May 1, 1986, now abandoned which is a continuation-in-part of U.S. patent application Ser. No. 06/457,126, filed Jan. 11, 1983, now U.S. Pat. No. 4,607,824.

BACKGROUND OF THE INVENTION

The invention relates generally to systems for absorbing and dissipating the impact energy of automobiles or other moving vehicles. More particularly, the invention relates to an improved highway barrier which will redirect the nose of an impacting vehicle away from a roadside hazard while at the same time dissipating kinetic energy of the impacting vehicle.

Rigid guardrails are usually positioned alongside vehicular traffic routes, especially highways, to prevent vehicles from colliding with fixed objects, other vehicles or from leaving the road. To this end, the guardrails must be rigid enough to prevent the lateral movement of an impacting vehicle. While guardrails function to prevent vehicles from impacting unyielding objects, they themselves may present a hazard to a vehicle impacting the end portion of the unyielding guardrail.

Energy attenuation and absorbing devices for highway abutments are known in the art. An example of such a unit is U.S. Pat. No. 4,352,484 to Gertz, et al. These devices are utilized to dissipate the impact energy of a vehicle. To this end, these barriers usually include a deformable structure or material which dissipates the energy of an impacting vehicle as it is crushed. Despite the success of these devices they are typically too expensive to be used to prevent vehicles from impacting guardrails.

Highway barriers have been developed for use with the end portions of guardrails. An example of these prior art devices are fender panels which are designed to telescope upon the application of an axial impact force. These prior guardrail barriers typically have difficulties dissipating the energy of large vehicles or vehicles traveling at high speeds. When these devices are impacted at high speeds, the fastening members are sometimes pulled through the panels causing the panels to separate and failing to telescope. Furthermore, if the telescoping panels do not dissipate a sufficient amount of the energy the impacting vehicle will hit the unyielding portion of the guardrail after the panels have telescoped. This can result in the fender panels of the guardrail spearing the car and seriously injuring its occupants.

Breakaway cable terminals are also used to dissipate the energy of a vehicle impacting the end portion of a guardrail. Basically, a breakaway cable terminal is a cable which extends from the first vertical support leg to a fender panel at a position in front of the second vertical support leg. Upon impact, the first vertical leg is designed to breakaway, thereby releasing the cable and minimizing the spearing forces. This design has had difficulty in preventing light weight vehicles travelling at high speeds from being speared by a fender panel upon axial impact with the guardrail.

SUMMARY OF THE INVENTION

The present invention is directed to an improved highway barrier which redirects an impacting vehicle away from a roadside hazard.

According to this invention, a highway barrier is provided for protecting an impacting vehicle from colliding with a roadside structure positioned alongside a roadway. This barrier comprises a beam having a forward and a rearward end. The rearward end of the beam is rotatably mounted to the roadside structure such that the beam is rotatable away from the roadway. A collapsible guardrail assembly is mounted to the forward end of the beam. This assembly includes a plurality of panels and means for mounting the panels together such that the panels extend alongside the roadway and adjacent panels are slidable with respect to one another to allow the panels to telescope together when struck by the impacting vehicle. The panels are supported by means which allow the panels to telescope together when struck by the vehicle. The guardrail assembly is effective to deflect the impacting vehicle away from the roadway as the guardrail assembly telescopes together when struck by the impacting vehicle. The beam is effective to deflect the impacting vehicle farther away from the roadway and the roadside structure as the beam rotates with respect to the roadside structure.

In the past, beams have been rotatably mounted to a roadside structure so as to redirect an impacting vehicle away from the structure. However, when a simple rigid beam is used without the collapsible guardrail assembly described above, there is a tendency for the beam to fail to rotate when the vehicle is approaching the beam axially. When this happens, the beam provides a rigid barrier which can do considerable damage to the vehicle and can injure the occupants of the vehicle. It has been discovered that the collapsible guardrail assembly described above cooperates with the rotatable beam to reduce the likelihood that the beam will spear the impacting vehicle. In particular, the collapsible guardrail assembly deflects the impacting vehicle away from the roadway as it telescopes together. In many cases, the impacting vehicle is deflected sufficiently by the collapsing guardrail assembly such that the vehicle either misses the rotatable beam entirely or strikes the rotatable beam at a sufficient angle to cause the beam to begin to rotate, thereby deflecting the impacting vehicle farther away from the roadway. Thus, the guardrail assembly cooperates with the rotatable beam to provide a markedly improved highway barrier.

The invention itself, together with further objects and attendant advantages, will best be understood by reference to the following detailed description, taken in conjunction with the accompanying drawings.

BRIEF DESCRIPTION OF THE DRAWINGS

FIG. 4 is a side elevation view of a portion of the guardrail end terminal of FIG. 1.

FIG. 5 is a cross-sectional view taken along line 5—5 of FIG. 4.

FIG. 6 is a cross-sectional view taken along line 6—6 of FIG. 4.

FIG. 7 is a side elevational view in partial cutaway of a slip base included in the guardrail end terminal of FIG. 1.

DETAILED DESCRIPTION OF THE PREFERRED EMBODIMENTS

The First Preferred Embodiment

The first preferred embodiment is shown in FIGS. 1–8*f*, and it includes a plurality of nested fender panels which telescope in response to an axial impact force and a cable for urging a first fender panel laterally upon the application of the axial impact force. The fender panels and cable function to direct the nose of the impacting vehicle away from a hard point on the guardrail while at the same time dissipating the impact energy of the vehicle.

The fender panels of this first embodiment are slotted and secured together in a nested fashion by fasteners which allow the fender panels to telescope upon the application of an axial impact force. The fender panels are supported above the ground on vertical support legs which are positioned on slip bases which allow the legs to break away from ground anchors so that the fender panels may telescope.

The first fender panel of this first embodiment and more specifically its vertical support leg is connected to a cable which is anchored to a front cable anchor located in front of the fender panels and a rear cable anchor located perpendicular to the guardrail. The cable is positioned so that when an axial impact force starts the first panel telescoping the cable will urge the fender panel laterally. This will cause a "lateral pole vaulting effect" which will urge the vehicle away from the hard point on the guardrail.

This first preferred embodiment provides important advantages in that it both dissipates kinetic energy of the impacting vehicle and redirects the vehicle away from the hard point. Thus the vehicle is both slowed and shifted laterally, and in many cases the vehicle is prevented from colliding with the hardpoint even though the vehicle is not brought to a rest before the hard point.

Figures 1, 1A, 2, 3:
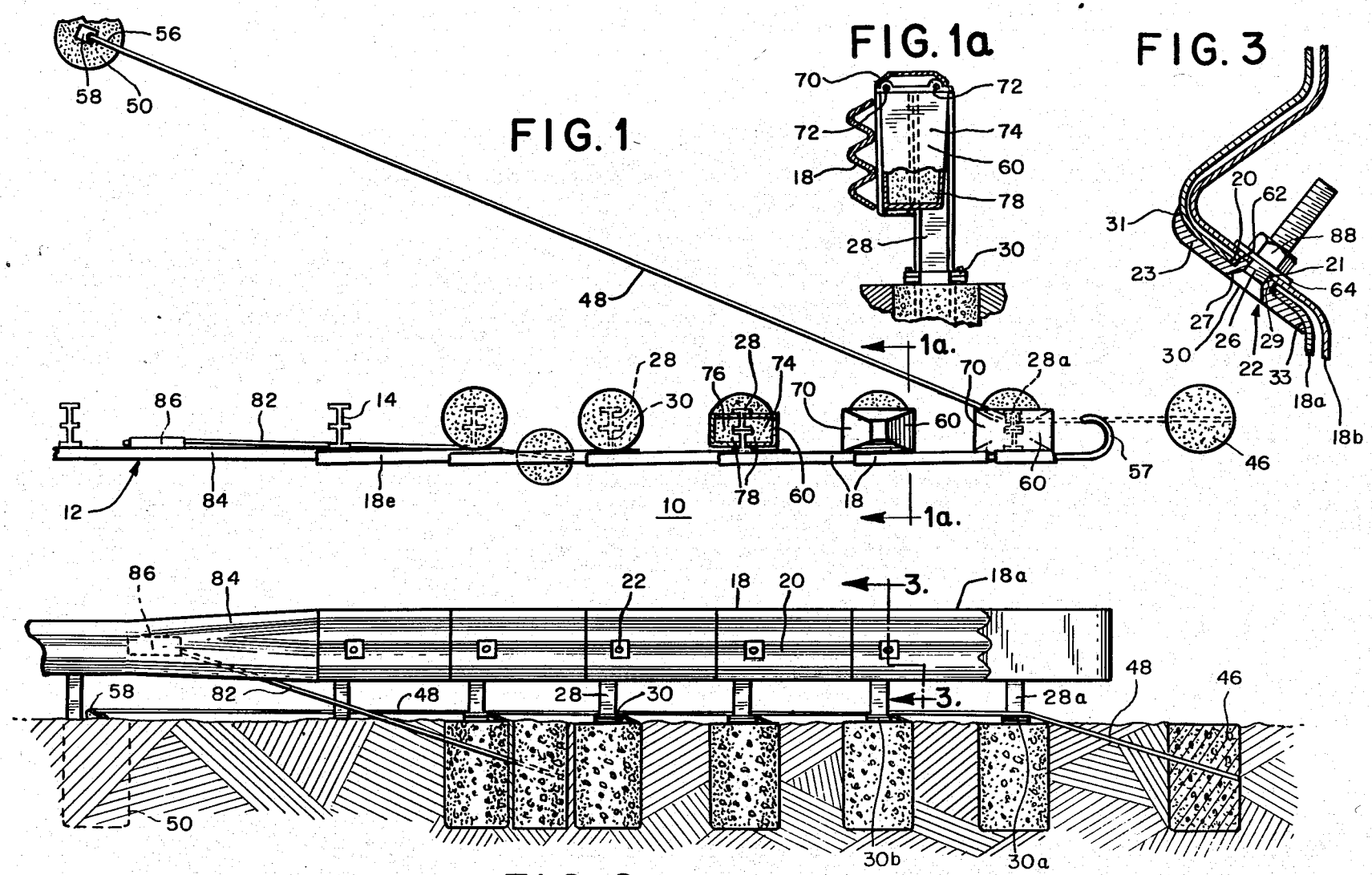
FIG. 1 is a plan view of a first preferred embodiment of a guardrail end terminal.
FIG. 1*a* is a side elevation view of a sand saddle utilized in the guardrail end terminal of FIG. 1.
FIG. 2 is a side elevation view of the guardrail end terminal of FIG. 1.
FIG. 3 is a cross-sectional view taken along line 3—3 of FIG. 2.
Figure 8:
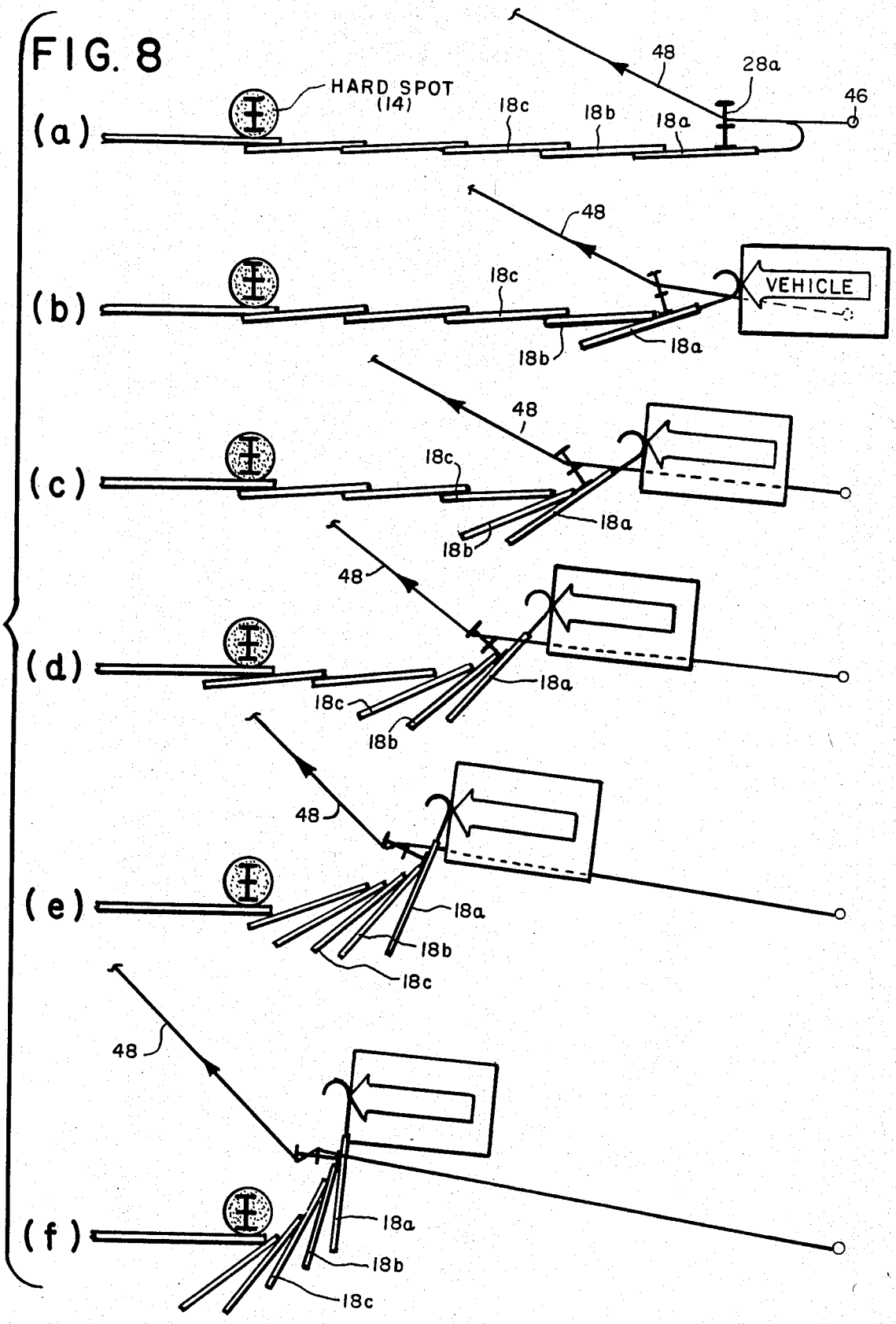
FIGS. 8*a*–8*f* are a series of schematic plan views which illustrate the lateral pole vaulting effect of the guardrail end terminal of FIG. 1.

Turning now to the drawings, FIG. 1 illustrates a plan view of the first preferred embodiment of the guardrail end terminal 10. The guardrail end terminal 10 is attached to and acts as the end portion of a guardrail 12. The guardrail end terminal 10 is designed to prevent vehicles from impacting head on the hard point 14 of the guardrail 12. The hard point 14 of the guardrail 12 is that portion of the guardrail which is not designed to yield upon impact with a vehicle. As will be described in greater detail below, the guardrail end terminal 10 is designed to redirect the front end of an impacting vehicle away from the hard point 14 while at the same time dissipating the energy of the impact force of the vehicle.

Referring now to FIGS. 2 and 4, the guardrail end terminal 10 includes a plurality of nested fender panels 18. The fender panels 18 include slots 20 and are secured together by a plurality of fastener members 22 which allow the fender panels to telescope upon the application of an axial impact force.

The fastener members 22 are designed to engage the slot 20 of one of the fender panels 18 and an aperture 21 of a second fender panel 18. By way of example, FIG. 3 illustrates the attachment of two fender panels 18*a* and 18*b* by a fastener member 22. The fastener member 22 includes a plate member 23 and a bolt 26. The plate member 23 has a preferably rectangular shape which conforms to the surface of the fender panel 18*a*, and thereby includes curved ends 31 and 33. The plate member 23 further includes a funnel shaped aperture 27 which leads to a neck portion 29. The aperture 27 and neck portion 29 are designed to receive a bolt 26. To this end, the bolt 26 includes a head 30 which conforms to the shape of the aperture 27 of the plate member 23.

The plate member 23, and more specifically the neck portion 29, is designed to be received within a slot 20 in a first fender panel 18*a* and rest on the shoulder 62 which surround an aperture 21 in the second fender panel 18*b*. Once so received, the plate member 23 is secured on a side of the fender panel 18*a* by the bolt 26 which is received within the aperture 27 and then secured in place by a washer 64 and nut 88.

The fastener member 22 is constructed so that it does not clamp the two fender panels 18*a* and 18*b* together but rather secures them in juxtaposition to one another with a sufficient tolerance to allow the first fender panel 18*a* to telescope into the second fender panel 18*b*. Because of the construction of the fastener member 22 and specifically the plate member 23, when a sufficient axial impact force is applied to the first fender panel 18*a* the fastener member 22 will ride in slot 20 allowing the panel 18*a* to move axially with respect to the second fender panel 18*b* in a telescoping fashion. The axial movement of the first fender panel 18*a* will only be impeded upon the end of the slot 20 reaching the fastener member 22.

The funnel shape of the aperture 27 in the plate member 23 and shape of the head 30 of the bolt 26 prevent the bolt 26 from being pulled through the slot 20 when the fender panels 18 are telescoping in response to an axial impact force. Thus, when an axial impact force is applied to the fender panels 18 the fastener members 22 allow the panels to telescope along the slots 20.

The fender panels 18 are supported above the ground 42 by vertical support legs 28. Preferably, the support legs 28 are steel I Beams. In the preferred embodiment illustrated in the drawings, the vertical support legs 28 are bolted to a blockout 30 which is bolted to the fender panels 18. The blockouts 30 prevent automobiles with small wheels from snagging on the vertical support legs 28 when they impact the guardrail end terminal 10 at a glancing angle. The blockouts 30 are also preferably steel "I Beams."

As shown in FIGS. 4 and 5, the vertical support legs 28 are secured to a slip base 30. The slip base 30 includes a top plate 32 and a bottom plate 34 which are secured to each other. The bottom plate 34 is fastened, as for example by welding or bolting, to a ground anchor 70. Various types of ground anchor constructions 70 are known in the art. By way of example, the ground anchor 70 may include a steel rectangular tubing 72 which is plugged into a concrete footing 74 to securely position it in the ground 42. The top plate 32 is welded to the vertical support leg 28.

Referring now to FIGS. 5 and 7, the top and bottom plates 32 and 34 each include four slots 36, each slot being designed to receive a bolt 38 which secures the plates 32 and 34 together. The plates 32 and 34 are large enough so that they will not yield upon a lateral impact force. The slots 36 are open ended so that when a sufficient axial impact force is applied to the vertical support leg 28 the plates 32 and 34 will slide apart, as illustrated in FIG. 7. To insure that the plates 32 and 34 will slip apart the plates 32 and 34 are separated by four washers 39. The washers 39 define the area at which the plates 32 and 34 are joined so that the force needed to cause the plates 32 and 34 to slide apart can be controlled. It has been found that if the plates 32 and 34 are bolted together at 60 foot-pounds (8.28 Kg-m) sufficient energy will be dissipated by the slip bases.

As shown in FIG. 5, the vertical support legs 28 may include an angle plate 68. The angle plate 68 is attached to the front of the top plate 32 and helps to prevent the support legs 28 from becoming hung up on each other as they breakaway in response to an axial impact force. Because there is no vertical support leg 28 to collapse into it, the first vertical support leg **28*a* does not include an angle plate 68**.

Referring now to FIGS. 1, 4 and 6, the first vertical support leg **28*a* is of substantially the same construction as the other vertical support legs 28 except that it contains an aperture 40. The aperture 40 is located in the lower portion of the leg 28*a* and is designed to receive a cable 48. As shown in FIG. 2, the cable 48 extends from a front cable anchor 46 through the aperture 40 in the first vertical support leg 28*a* to a rear cable anchor 50. As will be described in detail below, the cable 48 urges the first fender panel 18*a*** laterally upon the application of an axial impact force.

The rear cable anchor 50 is located perpendicular to the guardrail 12 and includes an earth anchor 56 and rod 58. Preferably, the ground anchor 56 is a typical concrete anchor. The rod 58 is secured within the ground anchor 56 and is designed to secure an end of the cable 48. The front cable anchor 46 is located in front of the first vertical support leg **28*a* and also includes a ground anchor which secures the front end of the cable 48. The cable 48 is passed through the aperture 40 in the first vertical support leg 28*a* and then secured to the front and rear cable anchors 46 and 50**.

Thus, the cable 48 extends from the front cable anchor 46 through the first vertical support leg **28*a* to the rear cable anchor 50. Because the rear cable anchor 50 is located perpendicular to guardrail 12 the cable 48 extends from the front first vertical support leg 28*a* at an acute angle to the guardrail end terminal 10. As shown in FIG. 6, to insure that the cable 48 extends from the first vertical support leg 28*a* at the proper angle and to prevent the cable from wearing through on the leg 28*a* a sleeve 59 extends from the aperture 40 on each of its sides and receives the cable 48. The sleeve 59 also helps to dissipate the energy of an impacting vehicle by being dragged down the cable 48** during impact and thereby exerting a deacceleration force.

The cable 48 provides redirectioning to a vehicle which impacts the guardrail end terminal 10 head on. To this end, the cable 48 is designed to urge the first fender panel **18*a* laterally upon application of an axial impact force. By urging the first fender panel 18*a* laterally, the cable 48 causes, as will be described in more detail below, a "lateral pole vaulting effect" on the panels 18. The cable 48 is preferably constructed from steel and is sized such that it will stretch to about 1 to 1½% its length upon application of an impact force. By experimentation it has been found that a steel cable 48 with a diameter of ⅞ of an inch (2.2225 cm) is sufficient to urge the panels 18** laterally.

Referring now to FIGS. **8*a*–8*f*, the lateral pole vaulting effect of the guardrail end terminal 10 is illustrated. When a vehicle impacts the guardrail end terminal 10 head on, the first panel 18*a* is forced backwards telescoping into the second panel 18*b*. To this end, the first panel 18*a* slides axially along the fastening member 22. As the vehicle continues its motion, it impacts a second vertical support leg 28*a* causing the top plate 32 of the second slip base 30 to slip away from the bottom plate 34**.

The rearward movement of the first panel stretches the cable 48 until the cable will not stretch any further (approximately 1 to 1½% of its length). The cable 48 then urges the first panel **18*a* laterally causing the first fender panel 18*a* to give a small lateral impulse to the nose of the impacting vehicle. As the first fender panel 18*a* reaches the end of its travel the second fender panel 18*b* begins to telescope into the third fender panel 18*c*. The first fender panel 18*a* will reach the end of its axial movement before the second slip base 30*b* can break free. Each slip base 30 dissipates some of the energy of the impacting vehicle. This process continues until all the fender panels 18 of the guardrail end terminal 10 have broken free giving a large lateral force to the impacting vehicle causing it to be directed away from the hard point 14**.

Because the slip bases 30 may not remove a sufficient amount of energy to keep an impacting vehicle from hitting the hard point 14, the guardrail end terminal 10 may include sand saddles 60. The sand saddles 60 are containers which are filled with a desired amount of sand 78. As illustrated in FIG. **1*a*, each sand saddles 60 includes two containers 74 and 76. Each container 74 and 76 includes a bolt 72 which allows the two containers to be attached to each other to form the sand saddle 60. The containers 74 and 76 have a construction that conforms to the blockouts 30 and I Beams 28. The sand saddle 60 also includes a lid 70 which snaps over the two containers 74 and 76**.

It has been found that by adding about 200–300 pounds (90–135 Kg) of sand to the sand saddles 60, the energy of most impacting vehicles is sufficiently reduced, through momentum transfer to the sand, to allow the guardrail end terminal 10 to redirect the impacting vehicle and thereby prevent the vehicle from impacting the hard point 14. Preferably, the first two sand saddles 60 are filled with 200 pounds (90 Kg) of sand and the third sand saddle is filled with 300 pounds (135 Kg) of sand.

By adjusting the angle at which the cable 48 extends away from the first fender panel 18*a*, the mass of the vehicle that can be redirected can be increased. But, it should be noted that the greater the angle of the cable 48, the more unyielding the guardrail end terminal 10 will be. It has been found that an angle of approximately 25° redirects most road vehicles away from the hard-point 14 of the guardrail 12 while at the same time providing a guardrail end terminal 10 which is sufficiently yielding to protect the occupants of most impacting vehicles.

The first fender panel 18*a* may include a bull nose 57. The bull nose 57 provides a curved area for an impacting vehicle to hit instead of a pointed fender panel 18.

Referring now to FIGS. 1 and 2, the guardrail end terminal 10 may be used with a standard anchor cable system. The standard anchor cable system includes a second cable 82 which extends from the ground anchor 46 of a vertical support leg 28 to a transition fender panel 84 in the guardrail 12. The transition fender panel 84 is connected to the last fender panel 18*e* of the guardrail end terminal 10 and the hard point 14 of the guardrail 12. The second cable 82 is received within a rectangular block 86 which is attached to the transition fender panel 84.

The Second And Third Preferred Embodiments

The second and third preferred embodiments of FIGS. 10–15 both include a collapsible guardrail assembly, substantially identical to that described above in conjunction with FIGS. 1–8, in combination with a beam which is rotatably mounted to a roadside hazard.

Figure 10:
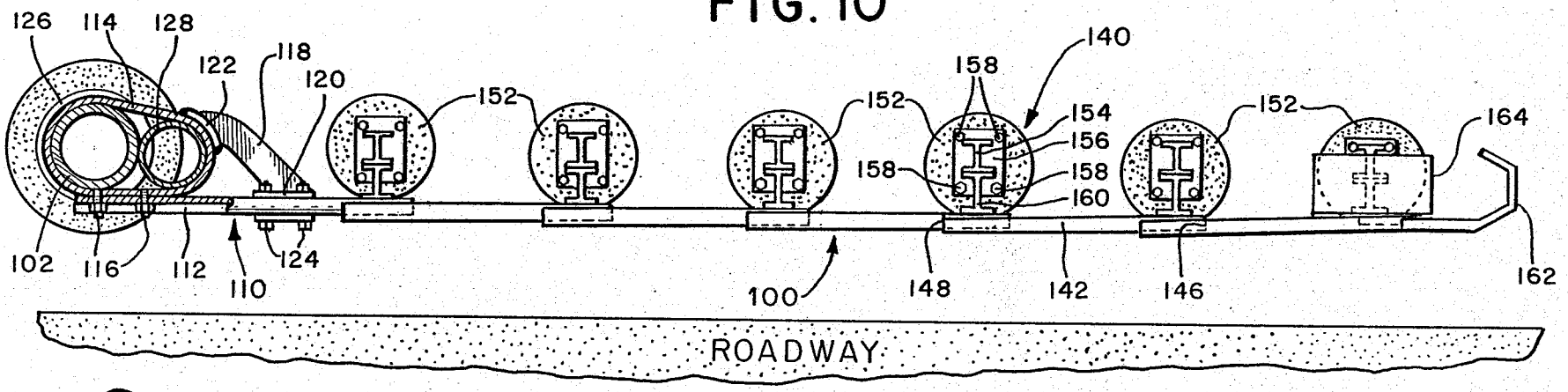
FIG. 10 is a plan in partial section taken along line 10—10 of FIG. 9.
Figure 9:
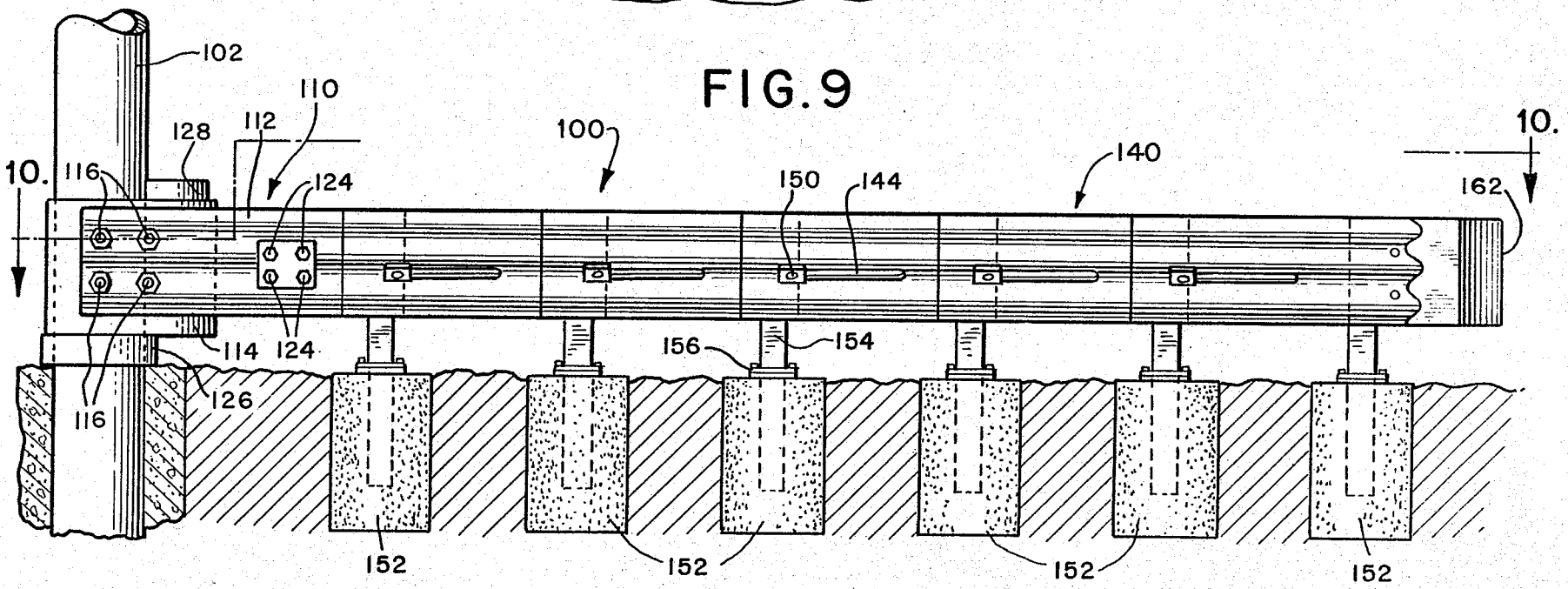
FIG. 9 is a side elevation of a highway barrier which incorporates a second preferred embodiment of this invention.
Figure 11:
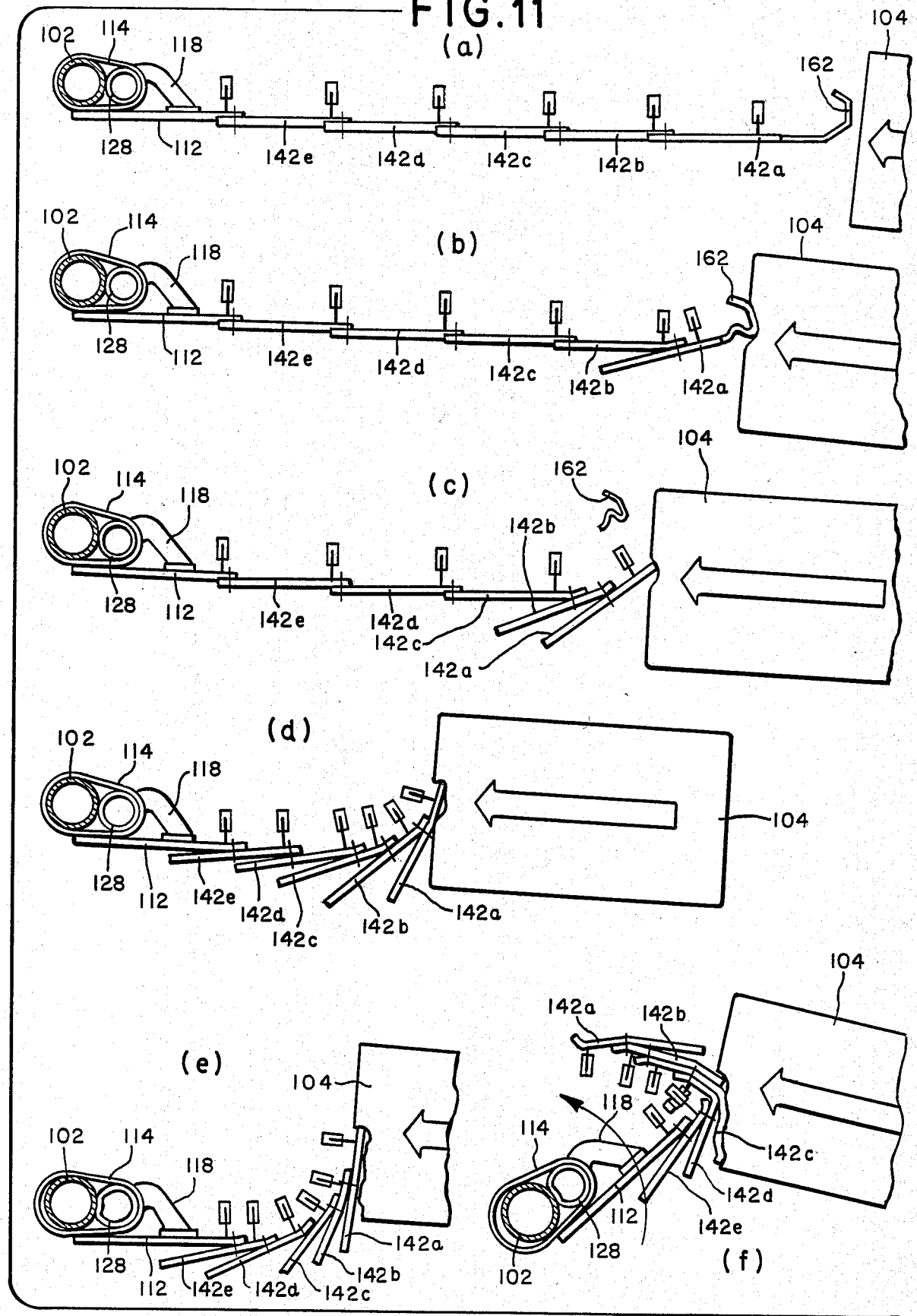
FIGS. 11*a*–11*f* are six consecutive plan views showing the operation of the embodiment of FIGS. 9 and 10 when struck by an impacting vehicle.
Figure 12:
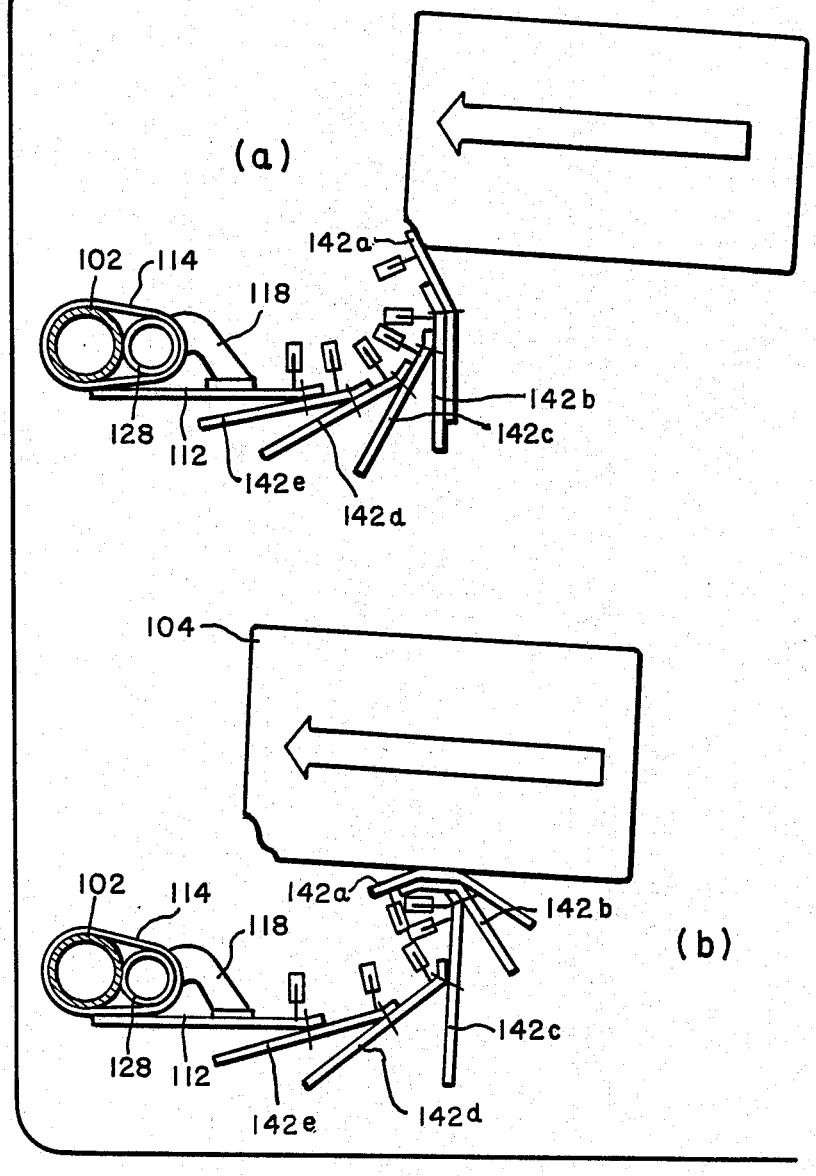
FIGS. 12*a* and 12*b* are consecutive plan views showing a second mode of operation of the embodiment of FIGS. 9 and 10 when struck by an impacting vehicle.

Turning now to FIGS. 9–12*b*, the second preferred embodiment includes a highway barrier 100 which is mounted alongside of and generally parallel to a roadway as shown in FIG. 10. The highway barrier 100 is provided to protect vehicles which leave the roadway from colliding with a roadside hazard such as a pole 102.

The barrier 100 includes a beam assembly 110 which is rotatably mounted to the pole 102. This beam assembly 110 includes a rigid beam 112 which may, for example, be a Thrie beam of the type described above in conjunction with the first embodiment. A steel band 114 is mounted around the pole 102 to encircle the pole 102, and the rearward end of the beam 112 is fastened securely to the band 114 by fasteners 116. A rigid brace 118 is provided which includes a forward flange 120 that is rigidly bolted to the beam 112 by fasteners 124 as well as a rearward flange 122 which is rigidly secured to the band 114, as for example by welding. A collar 126 is rigidly secured to the pole 102, and the collar 126 supports the band 114 in vertical position, without interfering with the freedom of the band 114 to rotate about the pole 102. A tubular spacer 128 is mounted within the band 114 between the pole 102 and the brace 118. The spacer 128 is sized to be more readily deformed than the pole 102 such that the spacer 128 will deform before the pole 102 during the impact of a vehicle. The band 114 can be formed for example of steel of $\frac{1}{4}$ to $\frac{3}{4}$ inch thickness and should preferably be strong enough to ensure that the beam 112 remains rotatably mounted to the hazard 102 during normal operation of the highway barrier 100. The spacer 128 is typically formed of steel tubing of $\frac{1}{8}$ to $\frac{1}{2}$ inch in wall thickness.

The barrier 100 also includes a collapsible guardrail assembly 140. This guardrail assembly 140 is quite similar to that described above in conjunction with the first preferred embodiment and includes an array of axially extending overlapping panels 142. Each of the panels 142 defines an axially extending slot 144 positioned between the respective forward end 146 and rearward end 148 of the panel 142. Fasteners 150 of the type shown above in FIG. 3 extend between the forward end 146 of the inner of each pair of overlapping panels 142 and the slot 144 of the outer of each pair of overlapping panels 142. In this embodiment, the fasteners 150 pass through openings in the forward ends 146 of the panels 142, and these openings are preferably positioned within six inches of the extreme forward edge of the panels 142. Preferably, the fasteners 150 are each positioned forwardly of the adjacent blockout 160.

The panels 142 are supported above the ground on ground supports 152 which in this embodiment take the form of separate concrete foundations. Of course, a single concrete slab or other suitable foundation may be substituted in alternate embodiments. The ground supports 152 support vertical panel supports 154, which in this embodiment take the form of I Beams as described above in conjunction with the first preferred embodiment. Each of the panel supports 154 is secured to the respective ground support 152 by a respective slip base 156 of the type described above in conjunction with FIG. 7. In each case, four fasteners 158 are included in the slip base 156 to secure the ground support 152 to the panel support 154. The slip bases 156 are arranged to resist lateral forces exerted transverse to the longitudinal extent of the guardrail assembly 140, while allowing the panel supports 154 to move axially, off of the ground supports 152, in response to axial forces applied by an impacting vehicle. Generally, the rearward slip base 156 which supports the forward end of the beam 112 is fastened together more tightly than the other slip bases 156 to cause it to release last.

In each case an I Beam blockout 160 is bolted between the respective panel support 154 and the forward end 146 of the respective panel 142. The blockouts 160 space the panels 142 laterally towards the roadway with respect to the panel supports 154. The forward most end of the guardrail assembly 140 defines a curved nose piece 162. In this embodiment the curved nose piece 162 is formed of a plastic which deforms easily to allow the impacting vehicle to engage the forward most end of the front fender panel 142. Also, one or more of the panel supports 154 may support a container 164, similar to that described above in conjunction with FIG. 1*a*. These containers 164 are preferably adapted to contain between two and three hundred pounds of sand to increase the inertial mass of the guardrail assembly 140.

Turning now to FIGS. 11*a*–11*e*, these figures illustrate one mode of operation of the barrier 100 when struck by an impacting vehicle 104. Preferably, the slip base 156 at the forward end of the rotatable beam 112 is tightened to a greater extent than the remaining slip bases 156 so that it is the last to release. In many applications, it is preferable to provide the two forward most slip bases 156 with flared openings to increase the angular range of impact directions that will cause the slip bases 156 to release.

FIG. 11*a* shows the barrier 100 in its original position with a vehicle 104 proceeding axially toward the pole 102. As shown in FIG. 11*b*, the first step in the collision is for the forward most slip base 156 to release and the forward most panel 142a to slide rearwardly with respect to the remaining panels 142b–142e. As shown in FIG. 11c, when the forward most panel 142a moves to the rear to the maximum extent permitted by the slot 144, the forward most panel 142a tends to rotate away from the roadway, thereby exerting a lateral force on the impacting vehicle 104 which tends to move the vehicle 104 away from the roadway. This lateral force is a result of the "pole vaulting effect" discussed above.

This action of the collapsing guardrail assembly 140 is provided by the asymmetrical structure of the telescoped panels 142. When the forward most panel 142a is fully telescoped, the rearward end 148 of the forward most panel 142a overlaps to a large extent with the second panel 142b. This overlap substantially prevents the forward most panel 142a from rotating towards the roadway. However, as explained above, the fastener 150 is secured to the extreme forward end 146 of the second panel 142b, which is relatively weak with regard to its ability to resist rotation of the forward most panel 142a away from the roadway. Because of the above described asymmetry with respect to forces required to bend the forward most panel 142a away from the roadway as compared with the forces required to bend the forward most panel 142a towards the roadway, the forward most panel 142a tends to rotate away from the roadway during the impact (counterclockwise as shown in FIG. 11c), thereby pushing the impacting vehicle 104 away from the roadway as well.

Of course, once the forward most panel 142a has telescoped completely, the second panel 142b begins to move rearwardly and leaves its slip base 156. This process of consecutive telescoping continues as shown in FIG. 11d, with each of the panels 142 exerting a lateral force on the impacting vehicle 104 away from the roadway as the collapse of the guardrail assembly 140 continues.

In the event this progressive collapse of the guardrail assembly 140 continues to the point where the vehicle 104 exerts significant compressive forces on the rotatable beam 112, such compressive forces on the beam 112 will cause the beam 112 to indent the spacer 128 against the pole 102, thereby releasing the slip base 156 of the beam 112. Once the slip base 156 is released, the beam 112 is free to rotate about the pole 102. The beam 112 is relatively rigid, and it exerts a large lateral force on the impacting vehicle 104 as it is rotated around the pole 102 by the vehicle 104. This large lateral force moves the vehicle 104 farther away from the roadway, thereby diverting the vehicle 104 around the pole 102.

It should be understood that the beam 112 will not be caused to rotate with respect to the pole 102 in many cases. As shown in FIGS. 12a and 12b, in the event the vehicle 104 is positioned and oriented such that the collapsing guardrail assembly 140 moves the vehicle 104 sufficiently away from the roadside, the guardrail assembly 140 will buckle, allowing the vehicle 104 to move past the pole 102 without rotating the beam 112.

Figure 14:
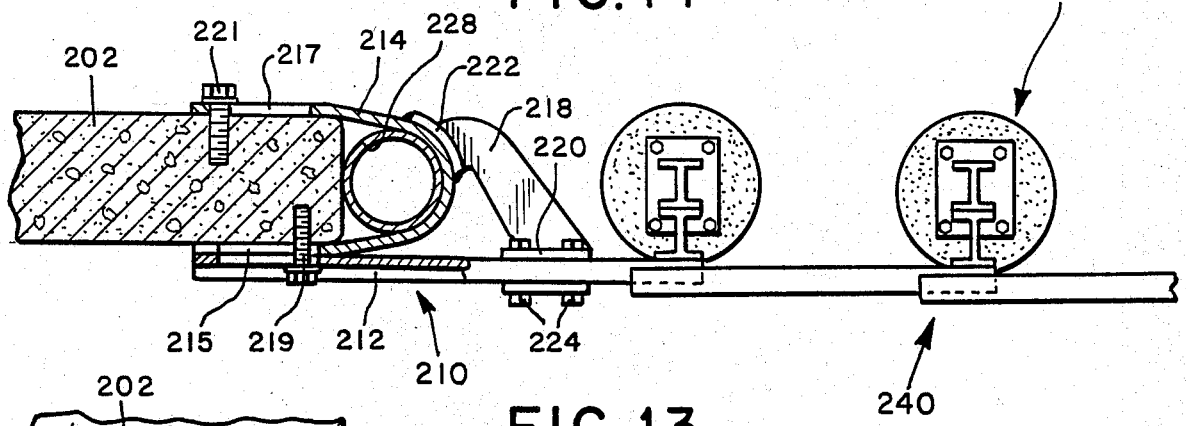
FIG. 14 is a plan in partial section taken along lines 14—14 of FIG. 13.
Figure 13:
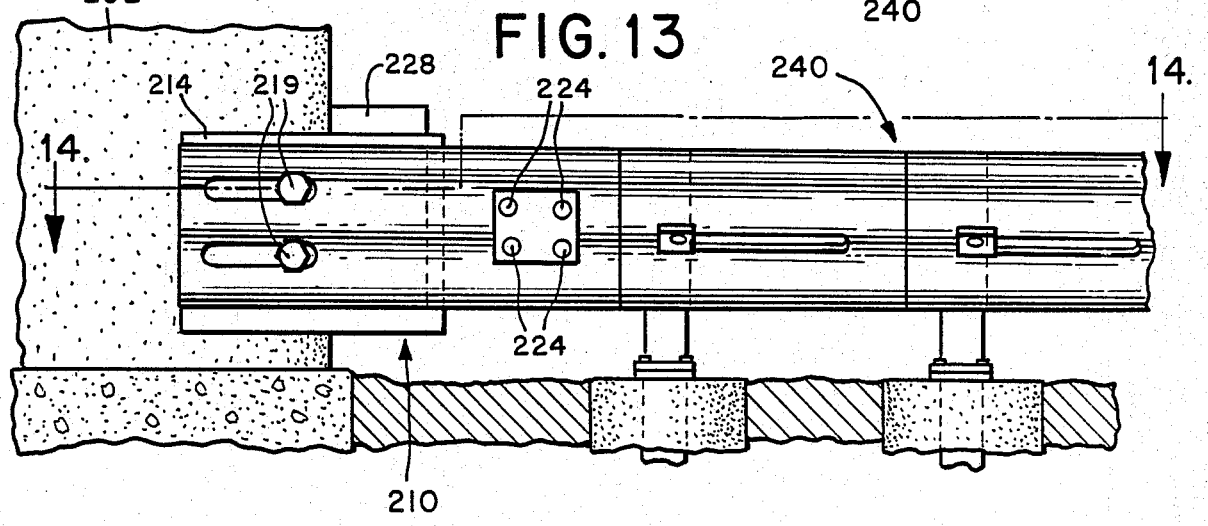
FIG. 13 is a partial side elevation of a highway barrier which incorporates a third preferred embodiment of this invention.
Figure 15:
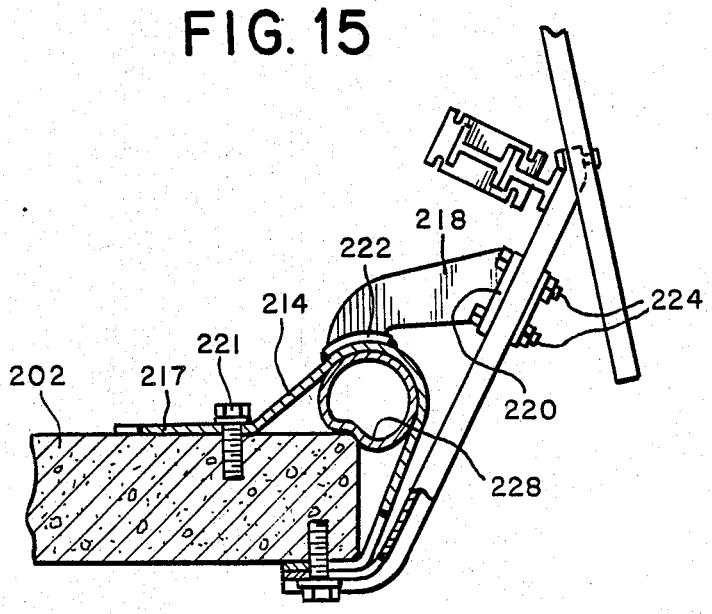
FIG. 15 is a plan corresponding to FIG. 14 showing the beam in a rotated position after impact by a vehicle.

The preferred embodiment of FIGS. 9–12 is adapted for use with a cylindrical roadside hazard such as a utility pole, lamp pole, bridge pier, or the like. Of course, if desired a cable similar to the cable 48 of FIG. 1 may be used with the embodiment of FIGS. 9–12. The present invention can readily be adapted for use with other relatively narrow roadside hazards which are not cylindrical. FIGS. 13–15 illustrate one such embodiment.

This third preferred embodiment includes a roadside barrier 200 adapted to protect an impacting vehicle from contact with a wall 202. This barrier 200 includes a beam assembly 210 which includes a rigid beam 212 similar to that described above in conjunction with FIG. 9. A band 214 is provided which defines a first pair of slots 215 and a second pair of slots 217 positioned on opposite sides of the wall 202. Fasteners 219, 221 are used to secure the band 214 to the wall 202. The fasteners 219 pass through the slots 215 and are positioned near the forward ends of the slots 215 to allow the band 214 to move forwardly with respect to the fasteners 219. Conversely, the fasteners 221 pass through the slots 217 and are positioned near the rearward end of the slots 217. Thus, the slots 215, 217 are positioned so as to retard the beam 212 from rotating towards the roadway and to facilitate rotation of the beam 212 away from the roadway.

A brace 218 is provided which includes a beam flange 220 that is mounted to the beam 212 by fasteners 224 and a band flange 222 that is welded to the band 214. The brace 218 operates similarly to the brace 118 described above. A spacer 228 is positioned between the wall 202 and the band 214. The barrier 200 also includes a guardrail assembly 240 identical to the guardrail assembly 140 described above.

The embodiment of FIGS. 13–15 operates in a manner similar to that described above in conjunction with FIGS. 11a–12b. In particular, the guardrail assembly 240 shifts the impacting vehicle 104 laterally away from the roadway as the guardrail assembly 240 collapses. In the event the impacting vehicle 104 engages the beam 212, the beam 212 is shifted rearwardly slightly, thereby partially collapsing the spacer 228. This releases the beam 212 from its slip base and allows the beam 212 to rotate. The fasteners 219, 221 cooperate with the slots 215, 217 to prevent the beam 212 from rotating towards the roadway while allowing the beam 212 to rotate away from the roadway. The momentum of the impacting vehicle therefore causes the beam 212 to rotate as shown in FIG. 15, away from the roadway. This rotation applies large lateral forces to the vehicle, thereby redirecting the vehicle around the wall 202.

From the foregoing, it should be apparent that two embodiments of an improved highway barrier have been disclosed which provide important advantages. The asymmetrical folding of the collapsible guardrail assembly imposes lateral forces on the impacting vehicle, thereby redirecting the vehicle to some extent away from the roadway. In the event these guardrail forces are not sufficient to cause the impacting vehicle to miss the roadside hazard, the vehicle engages the rotatable beam and the beam supplies large lateral forces which redirect the vehicle away from the hazard. Because of the manner in which the panels fold when collapsed, they provide a relatively large buffer area against the forward portion of the impacting vehicle, thereby reducing maximum surface loading on the vehicle to reduce the possibility of the guardrail spearing into the impacting vehicle.

Of course, it should be understood that a wide range of changes and modifications can be made to the preferred embodiments described above. For example, the number of fenders used in any particular highway barrier can be increased or decreased as appropriate for the particular application. As pointed out above, various types of ground bases including continuous concrete pads can be used. If desired, a planar keeper plate can be interposed between the moveable parts of the slip base to retain the fasteners in position prior to assembly. It is therefore intended that the foregoing detailed description be regarded as illustrative rather than limiting, and that it be understood that it is the following claims, including all equivalents, which are intended to define the scope of this invention.

I claim:

1. A highway barrier for protecting an impacting vehicle from colliding with a roadside structure positioned alongside a roadway, said barrier comprising:

a beam having a forward end and a rearward end;

means, coupled to the rearward end of the beam, for rotatably mounting the beam to the roadside structure such that the beam is rotatable away from the roadway; and a collapsible guardrail assembly mounted to the forward end of the beam, said guardrail assembly comprising;

a plurality of panels;

means mounting the panels together such that the panels extend alongside the roadway and mounting adjacent panels slidable with respect to one another to allow the panels to telescope together when struck by the impacting vehicle; and means coupled to the panels and connectable to at least one roadside element for supporting the panels and allowing the panels to telescope together when struck by the impacting vehicle;

said panels and mounting means configured to deflect the impacting vehicle away from the roadway as the guardrail assembly telescopes together when struck by the impacting vehicle; and said beam effective to deflect the impacting vehicle farther away from the roadway and the roadside structure as the beam rotates with respect to the roadside structure.

2. The invention of claim 1 wherein the means for mounting the panels together comprises:

means for defining a longitudinally extending slot in each of the panels; and means for interconnecting adjacent panels together, which interconnecting means comprises a plurality of fasteners, each extending through a respective one of the slots, said slots positioned such that the panels tend to collapse in a selected direction away from the roadway.

3. The invention of claim 1 wherein the means for supporting the panels comprises:

a plurality of panel supports, each defining an upper end secured to a respective one of the panels and a lower end;

a plurality of support surfaces, each aligned with a respective one of the panel supports; and a plurality of slip bases, each interconnected between a respective one of the panel supports and the respective support surface, each of said slip bases comprising means for preventing lateral movement of the panel support with respect to the support surface and means for permitting axial movement of the panel support with respect to the support surface to allow the panels to telescope together when struck by the colliding vehicle.

4. The invention of claim 1 wherein the means for rotatably mounting the rearward end of the beam to the roadside structure comprises:

a band which encircles the roadside structure; and means for securing the band to the rearward end of the beam.

5. The invention of claim 4 wherein the rotatably mounting means further comprises a collapsible cylinder interposed between the band and the roadside structure adjacent the securing means.

6. The invention of claim 4 wherein the rotatably mounting means further comprises;

a collar secured to the roadside structure beneath the band to rotatably support the band in place.

7. The invention of claim 1 wherein the means for rotatably mounting the rearward end of the beam to the roadside structure comprises;

a band;

first means for securing the rearward end of the beam to the band; and second means for rotatably securing the band to the roadside structure, said second means comprising:

means for defining a first slot in the band adjacent a first side of the roadway structure;

means for defining a second slot in the band adjacent a second side of the roadway structure; and first and second fasteners, each passing through a respective one of the slots and secured to the roadside structure;

said beam being rotatable with respect to the roadside structure as the slots slide with respect to the fasteners.

8. The invention of claim 7 wherein the fasteners are positioned at selected ends of the slots to impede rotation of the beam toward the roadway and to permit rotation of the beam away from the roadway.

9. A highway barrier for protecting an impacting vehicle from colliding with a roadside structure positioned alongside a roadway, said barrier comprising:

a band pivotably secured to the roadside structure;

a beam mounted to the band to extend axially alongside the roadway such that the beam is pivotable about the roadside structure;

a plurality of fender panels, each defining an axial slot, said fender panels extending generally axially in overlapping configuration;

a plurality of fasteners, each extending through a respective one of the slots and secured into a forward end of an adjacent rearward fender panel to allow the fender panels to telescope together in response to an axial force;

means for securing a rearward one of the fender panels to the beam;

a plurality of panel supports, each secured to the forward end of a respective one of the fender panels; and a plurality of slip bases, each secured between a respective one of the panel supports and a support surface, said slip bases oriented to allow axial movement of the panel supports while preventing lateral movement of the panel supports;

said slots and fasteners positioned to cause the fender panels to move away from the roadway as the fender panels collapse following telescoping;

said beam and band effective to swing the impacting vehicle away from the roadway.

10. The invention of claim 9 wherein the band encircles the roadside structure.

11. The invention of claim 9 wherein the band defines a plurality of slots, and wherein the band is secured to the roadside structure by a plurality of fasteners, each passing through a respective one of the slots.

12. The invention of claim 11 wherein the fasteners are positioned in the slots to resist pivoting of the beam toward the roadway and to facilitate pivoting of the beam away from the roadway.

13. The invention of claim 9 further comprising a collapsible cylinder interposed between the band and the roadside structure on a side of the roadside structure facing the fender panels.

14. The invention of claim 1 wherein the forward end of the collapsible guardrail assembly is connectable to roadside structure only by the supporting means.

15. The invention of claim 9 wherein all of the panel supports are connected only to roadside structure situated in general axial alignment with the beam and the fender panels.

* * * * *

UNITED STATES PATENT AND TRADEMARK OFFICE

CERTIFICATE OF CORRECTION

PATENT NO. : 4,784,515

DATED : November 15, 1988

INVENTOR(S) : William G. Krage et al.

It is certified that error appears in the above-identified patent and that said Letters Patent is hereby corrected as shown below:

On the cover sheet under the heading "FOREIGN PATENT DOCUMENTS" after "2279887 2/1976 France ..... 256/13.1", on the next line please insert --0115685 8/1984 EPO--.

Signed and Sealed this

Tenth Day of December, 1991

*Attest:*

HARRY F. MANBECK, JR.

*Attesting Officer*

*Commissioner of Patents and Trademarks*